US008286266B2

(12) United States Patent
Berman

(10) Patent No.: US 8,286,266 B2
(45) Date of Patent: Oct. 16, 2012

(54) MAGAZINE COVER COSTUME

(75) Inventor: Robert J. S. Berman, Haddonfield, NJ (US)

(73) Assignee: Silvertop Associates, Inc., Runnemede, NJ (US)

( * ) Notice: Subject to any disclaimer, the term of this patent is extended or adjusted under 35 U.S.C. 154(b) by 395 days.

(21) Appl. No.: 12/508,755

(22) Filed: Jul. 24, 2009

(65) Prior Publication Data

US 2011/0016601 A1 Jan. 27, 2011

(51) Int. Cl.
*A41D 27/08* (2006.01)
*G09F 21/02* (2006.01)

(52) U.S. Cl. ..... 2/244; 40/586

(58) Field of Classification Search ..... 2/244, 69; 224/101, 182, 606, 607, 623, 624, 625, 627, 224/628, 660, 664, 671; 446/26, 27, 28; 40/586, 584, 604, 606.01, 606.11, 606.13, 40/606.14, 611.08, 611.09, 610, 606.16; 434/395; 135/87, 121
See application file for complete search history.

(56) References Cited

U.S. PATENT DOCUMENTS 149,724 A * 4/1874 Coolidge ..... 396/3
377,556 A * 2/1888 Gomber ..... 396/3
929,980 A * 8/1909 Popper ..... 434/399
1,436,854 A * 11/1922 Brady ..... 40/586
1,487,936 A * 3/1924 Green ..... 40/326
1,888,909 A 11/1932 Crosthwait
2,412,415 A * 12/1946 Navon ..... 2/84
D155,752 S 10/1949 Vivaudou
2,647,261 A * 8/1953 Rassner ..... 40/586
2,864,613 A * 12/1958 Porter ..... 446/28
2,881,447 A * 4/1959 Shackelford ..... 2/49.1
3,009,698 A * 11/1961 Killius ..... 446/28
3,013,274 A 12/1961 Dike
3,018,100 A * 1/1962 Joseph ..... 472/133
3,021,985 A 2/1962 Sarver
3,042,399 A * 7/1962 Lewendowski ..... 446/26
3,055,133 A 9/1962 Anderson
3,570,158 A * 3/1971 Hackett ..... 40/452
3,582,993 A 6/1971 Keller
3,599,240 A 8/1971 Shapur
3,693,283 A * 9/1972 Marcus ..... 446/28
3,863,868 A * 2/1975 Oberle ..... 244/16
4,154,183 A * 5/1979 Nunez ..... 2/302
4,180,867 A * 1/1980 Ridgeway, Jr. ..... 2/89
4,241,721 A * 12/1980 Holly ..... 126/204
4,493,650 A * 1/1985 Kaufmann et al. ..... 434/178
4,498,199 A 2/1985 Margolis
4,627,110 A 12/1986 Tengs
(Continued)

FOREIGN PATENT DOCUMENTS

FR 2608823 A1 * 6/1988
(Continued)

*Primary Examiner* — Alissa L Hoey
(74) *Attorney, Agent, or Firm* — Pepper Hamilton LLP

(57) ABSTRACT

A customizable costume designed to look like a magazine cover and to be worn by a wearer such that the wearer appears to be a part of the magazine cover. The costume includes a panel having a hole cut therethrough, a plurality of attachment points and at least one channel disposed on at least one edge of the panel, at least one flexible strap passing through the plurality of attachment points configured to affix the costume to the wearer, and an internal frame affixed to the panel in the at least one channel, the frame configured to provide rigid support for the panel.

12 Claims, 5 Drawing Sheets

U.S. PATENT DOCUMENTS 4,656,670 A * 4/1987 Schluter ..... 2/92
4,710,979 A 12/1987 Bull et al.
4,924,613 A * 5/1990 Levin ..... 40/586
5,101,513 A * 4/1992 Bowers ..... 2/84
5,206,958 A 5/1993 Widenback
5,632,044 A 5/1997 Sloot
5,740,756 A * 4/1998 Ord ..... 116/173
5,813,051 A * 9/1998 Counter ..... 2/69
6,131,197 A * 10/2000 Wang ..... 2/50
6,192,635 B1 * 2/2001 Zheng ..... 135/126
6,357,049 B1 3/2002 Hoffman
6,357,510 B1 * 3/2002 Zheng ..... 160/354
6,393,745 B1 * 5/2002 Miki ..... 40/586
6,470,499 B1 10/2002 Joiner
6,523,288 B1 * 2/2003 Sackett ..... 40/539
6,742,191 B2 * 6/2004 Yang ..... 2/417
6,843,012 B1 1/2005 Dodd
7,367,148 B2 * 5/2008 Moody ..... 40/610
7,571,495 B2 * 8/2009 Emeth ..... 2/244
D608,980 S 2/2010 Brady
D634,511 S * 3/2011 Berman ..... D2/741
2002/0073914 A1 * 6/2002 Kinahan ..... 116/174
2003/0010371 A1 * 1/2003 Langley ..... 135/117
2003/0051381 A1 * 3/2003 Hernandez et al. ..... 40/586
2003/0079389 A1 * 5/2003 Eberly ..... 40/586
2003/0183264 A1 * 10/2003 Zheng ..... 135/126
2003/0188469 A1 * 10/2003 Torres ..... 40/586
2005/0278825 A1 12/2005 Altman
2007/0101473 A1 5/2007 Henderson
2009/0249528 A1 * 10/2009 Su ..... 2/89
2009/0276937 A1 * 11/2009 Zheng et al. ..... 2/79
2009/0280715 A1 * 11/2009 Palmeiri ..... 446/28

FOREIGN PATENT DOCUMENTS

FR 2791458 A1 * 9/2000

* cited by examiner

MAGAZINE COVER COSTUME

BACKGROUND

The present invention relates to specialized clothing or costumes. More particularly, the present invention relates to a costume having a customizable front panel and a related support structure.

Traditionally, costumes allow a wearer to transform or alter their appearance and/or personality. Costumes may include various components intended to disguise the appearance of the wearer, alter the physical stature of the wearer, or achieve some other similar deception. Some costumes are elaborately designed, including multiple components and pieces required to be worn to complete the effect the costume is aiming to achieve.

Additionally, many costume wearers would prefer for their faces to remain unaltered. This increases the ease with which a wearer can talk, laugh, eat, drink, or perform any other activity that requires freedom of movement and easy access to the face or head. Some costumes include a body suit with various designs applied, and the wearer's head is incorporated likewise into the costume. One example would be a bodysuit painted to look like a skeleton, where the head of the person wearing the costume would become the skeleton's head. This type of costume may also be elaborate, or require a bit of effort to put on or assemble. Additionally, the body suit may not provide any type of disguise or adequate cover for a wearer's body.

What is needed is a costume designed such that a wearer can quickly put on and take off the costume, the costume providing an opening for the wearer's head as well as a support structure for concealing the wearer's body.

SUMMARY

Before the present methods are described, it is to be understood that this invention is not limited to the particular systems, methodologies or protocols described, as these may vary. It is also to be understood that the terminology used herein is for the purpose of describing particular embodiments only, and is not intended to limit the scope of the present disclosure which will be limited only by the appended claims.

It must be noted that as used herein and in the appended claims, the singular forms "a," "an," and "the" include plural reference unless the context clearly dictates otherwise. Thus, for example, reference to a "costume" is a reference to one or more costumes and equivalents thereof known to those skilled in the art, and so forth. Unless defined otherwise, all technical and scientific terms used herein have the same meanings as commonly understood by one of ordinary skill in the art. As used herein, the term "comprising" means "including, but not limited to."

In one general respect, the embodiments disclose a customizable costume to be worn by a wearer. The costume includes a panel having a hole cut therethrough, a plurality of attachment points and at least one channel disposed on at least one edge of the panel, at least one flexible strap passing through the plurality of attachment points configured to affix the costume to the wearer, and an internal frame affixed to the panel in the at least one channel, the frame configured to provide rigid support for the panel.

In another general respect, the embodiments disclose a customizable costume to be worn by a wearer. The costume includes a panel having a hole cut there through positioned to accommodate the wearer's head, a plurality of attachment points and at least one channel disposed on at least one edge of the panel, at least one flexible strap passing through the plurality of attachment points configured to adjustably affix the costume to the wearer, and an internal frame affixed to the panel in the at least one channel, the frame configured to provide rigid support for the panel such that the panel is held tightly while the wearer is wearing the costume.

BRIEF DESCRIPTION OF THE DRAWINGS

Aspects, features, benefits, and advantages of the present invention will be apparent with regard to the following description and accompanying drawings, of which.

DETAILED DESCRIPTION

It is to be understood that at least some of the figures and descriptions of the invention have been simplified to focus on elements that are relevant for a clear understanding of the invention, while eliminating, for purposes of clarity, other elements that those of ordinary skill in the art will appreciate may also comprise a portion of the invention. However, because such elements are well known in the art, and because they do not necessarily facilitate a better understanding of the invention, a description of such elements is not provided herein.

Figure 1:
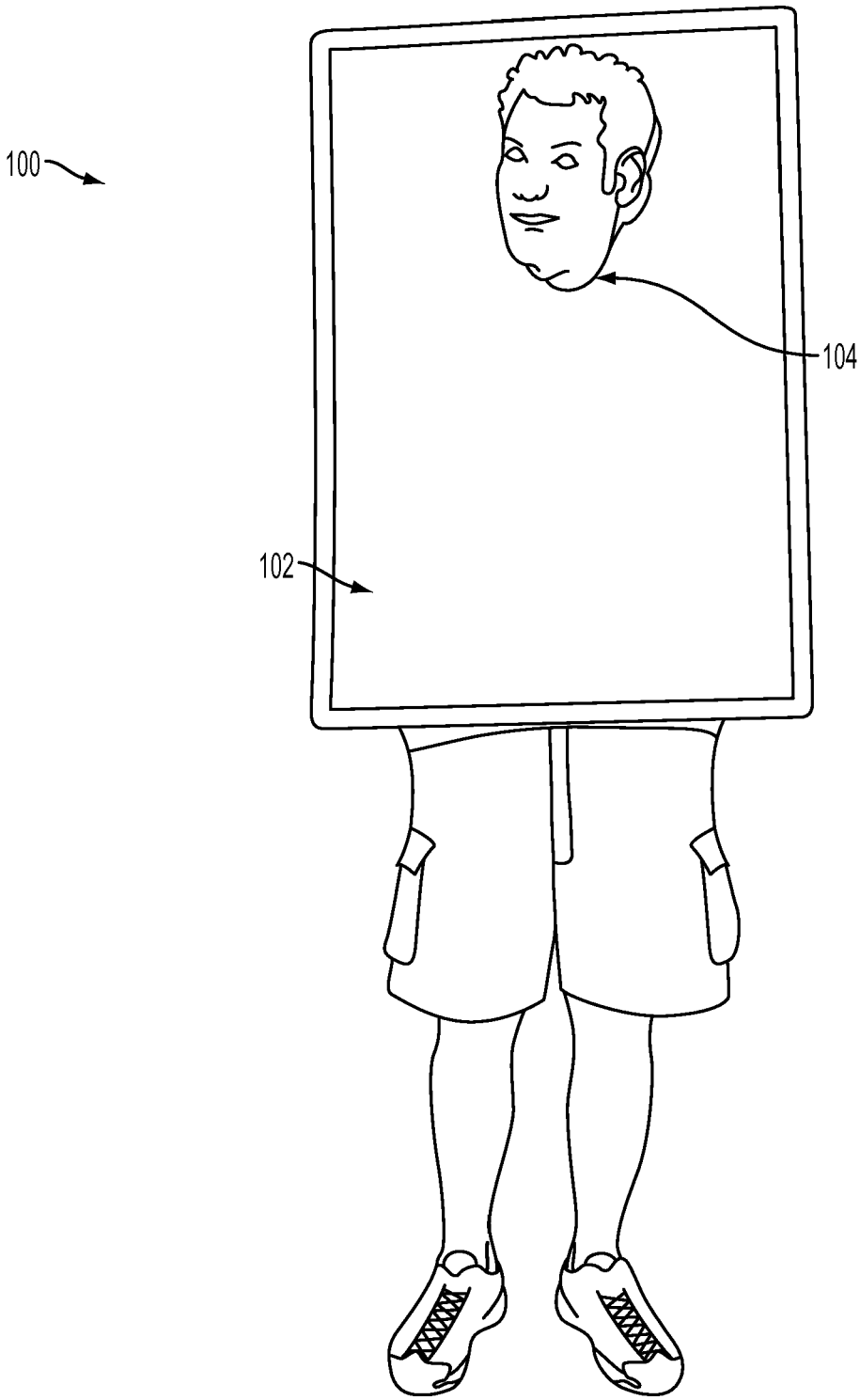
FIG. 1 illustrates a front view of a person wearing a costume according to an exemplary embodiment.

FIG. 1 illustrates a front view of a costume 100 according to an exemplary embodiment. The costume 100 may be designed such that a panel 102 is worn by a costume wearer such that the panel is held tightly against the front of the wearer's body. The panel 102 may be constructed from a variety of lightweight materials such as fabric, paper, cardboard, foam or any other suitable lightweight material.

The panel 102 may include a hole 104 for accommodating the wearer's head. Depending on the material used to construct panel 102, the hole 104 may be a sized to accommodate a majority of people's head sizes. If the panel 102 is constructed from an elastic material such as most fabrics, the hole 104 may be sized to be stretchable around the wearer's head. It should be noted that in costume 100, the panel 102 is shown with a single hole for the wearer's head. It should be recognized that multiple holes may be included to accommodate the wearer's arms or hands as well, or even the head and/or limbs of another.

Figure 2A:
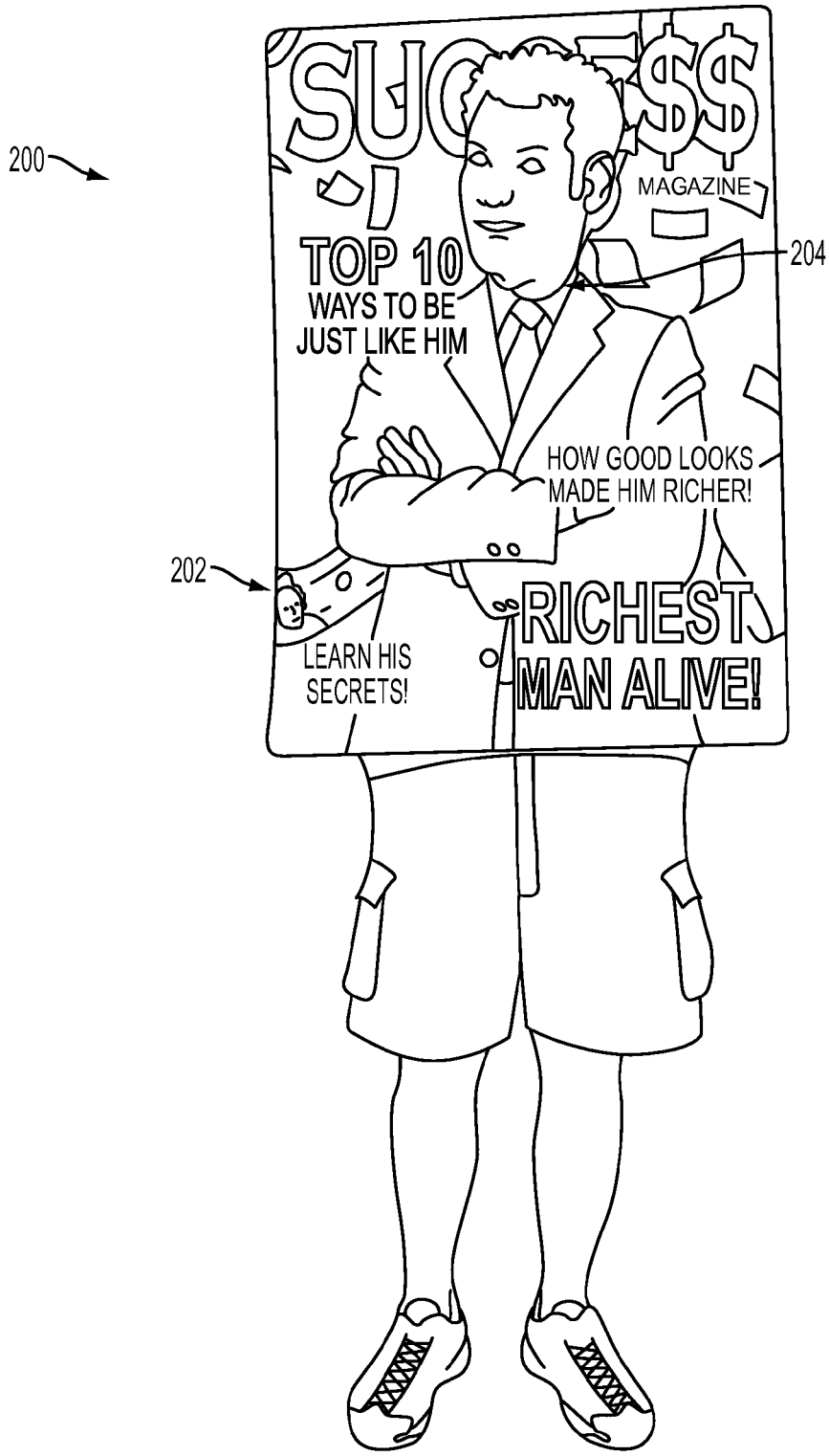
FIGS. 2A, 2B, and 2C illustrate front, side, and back views respectively, of a person wearing a decorated costume according to an exemplary embodiment.

FIG. 2A illustrates a costume 200 according to an exemplary embodiment. In costume 200, a panel 202 has been customized to include a design. In this example, the panel 202 has been customized to include a magazine cover. Various designs may be utilized such as magazine covers, movie posters, music album covers, video game covers, book covers, screen shots, or any other drawing or image chosen by the wearer or the costume's manufacturer. Additionally, the drawings or images may represent a fictitious publication (such as the "SUCCE$$" magazine cover shown in FIG. 2A), or a copyrighted image and/or trademark may be used (e.g., an actual magazine cover or movie poster).

Similar to panel 102, panel 202 includes a hole 204 through which the wearer may place their head. In this example, the hole 204 may be positioned on panel 202 such that the wearer's head comes through the panel at an appropriate place in relation to the design on the panel. As shown in FIG. 2A, the hole 204 is positioned where the head would be on the image of the person appearing on the cover of SUCCE$$ magazine. Thus, by putting on costume 200, the wearer's head becomes the head of the cover model of SUCCE$$ magazine. Similarly, the design of panel 202 may be positioned such that the body or legs of the person depicted in the design aligns with the body or legs of the costume wearer.

It should be noted that while a magazine cover depicting a person is shown in costume 200, as illustrated in FIG. 2A, the design is not limited to examples where only a person's body is included in the design.

Figure 2B:
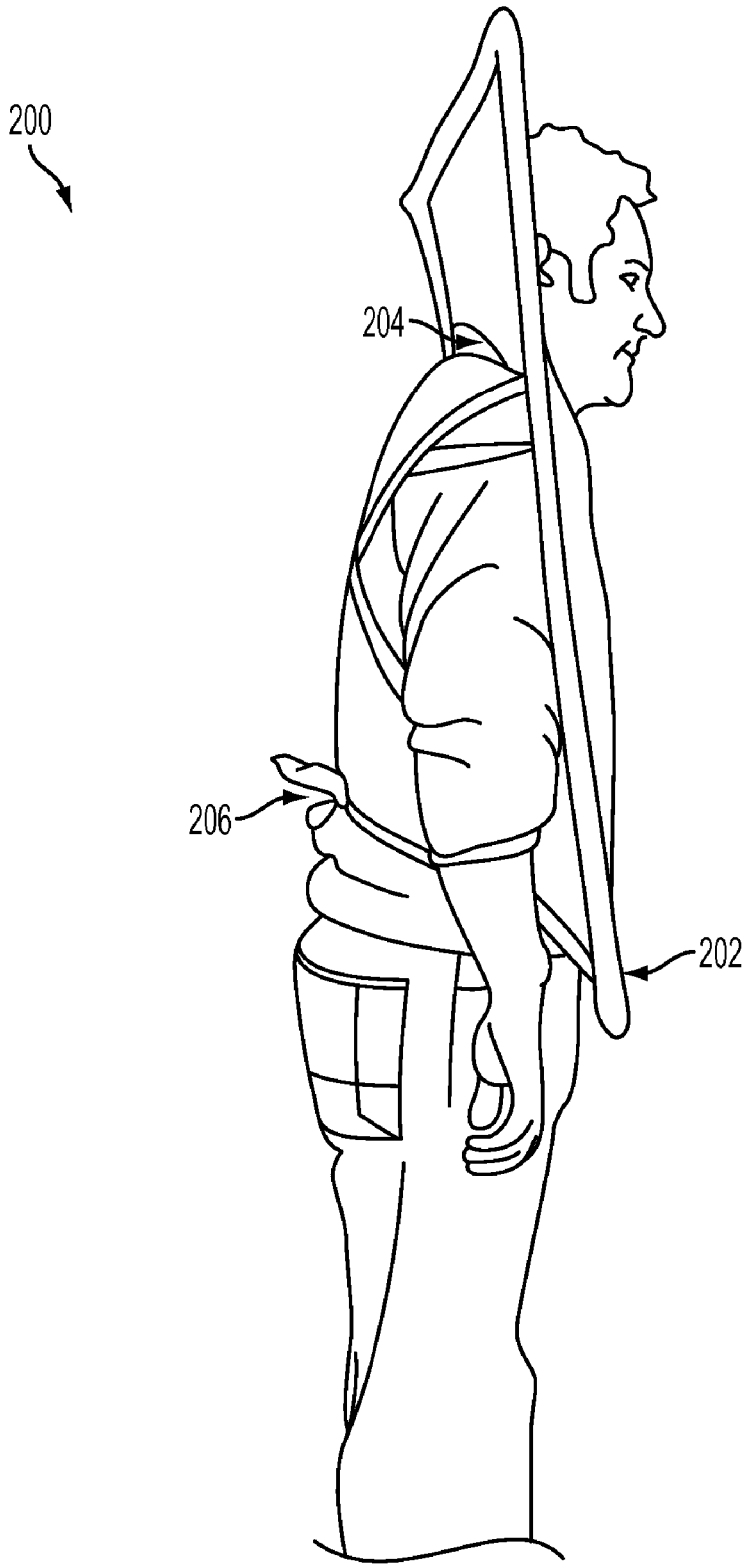

FIG. 2B illustrates a side view of costume 200. In this example, the design on panel 202 is limited to the side facing away from the wearer's body. The back side of panel 202 is left blank in this example. However, there may be an alternative embodiment where both sides of panel 202 are printed with a design such that the costume 200 is reversible, thereby providing the wearer with two distinct costumes.

Costume 200 further includes a series of straps 206. Straps 206 may be detachably or permanently attached to panel 202 and positioned such that they assist in holding the panel against the wearer's body. Straps 206 may be constructed from a similar material as the material used to make panel 202. However, in the event a non-pliable or weaker material is used to construct the panel 202, such as paper or cardboard, an alternative material may be used for the straps 206 such that thy are of sufficient strength and durability, and may be repeatedly secured and unsecured.

Figure 2C:
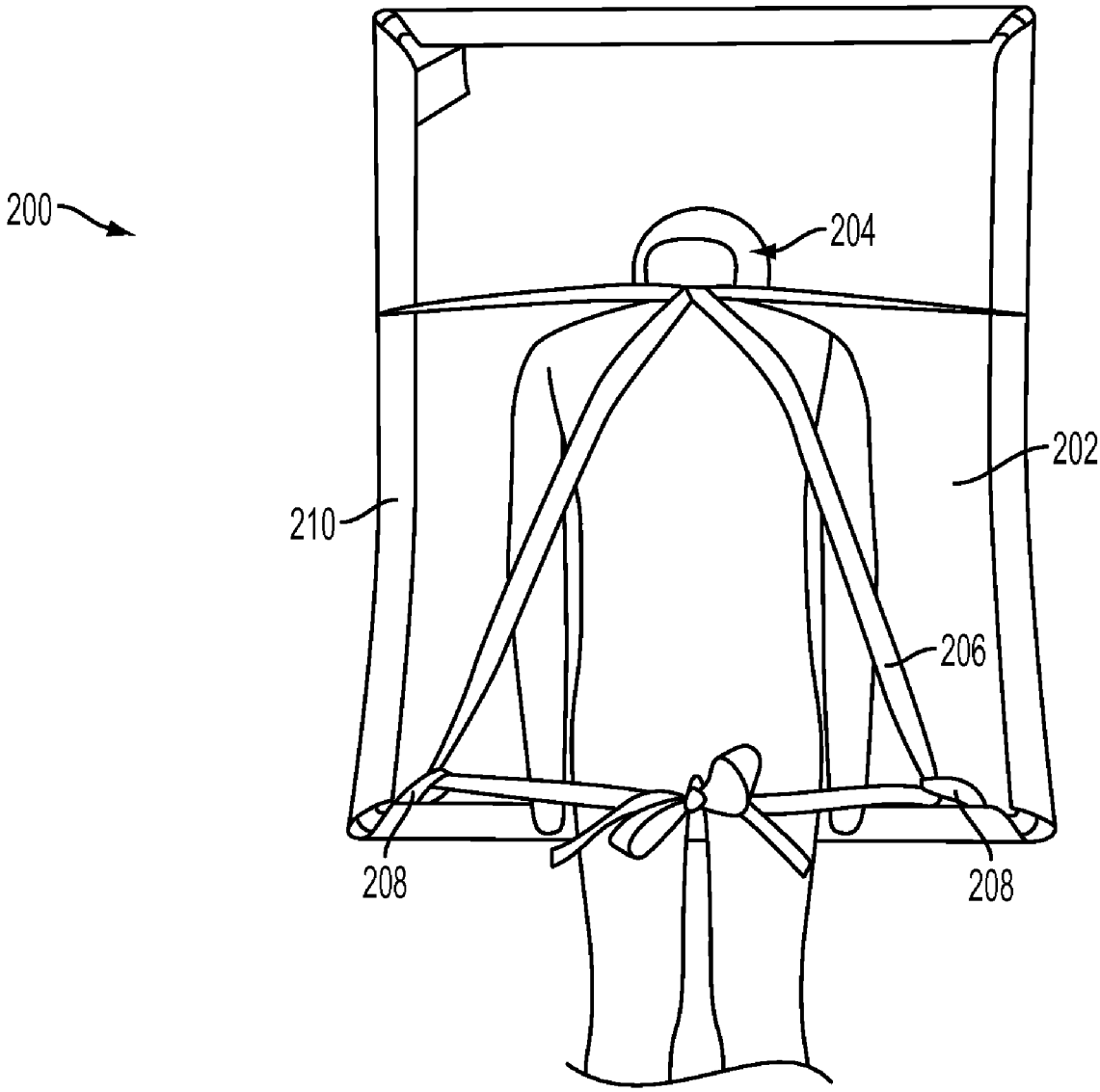

FIG. 2C illustrates a back view of costume 200. In this view, a cross pattern of straps 206 is shown as the straps are used to adjustably attach panel 202 to the wearer. The cross pattern also allows some of the weight of the costume 200 to be transferred to the wearer's shoulders such that the weight of the costume is not supported entirely by the wearer's neck at hole 204. Multiple attachment points 208 may be included such that straps 206 attach at multiple locations to the panel 202. Attachment points 208 may include loops constructed from a similar material as the panel 202, or other attachment devices such as metal rings, plastic rings, or any other suitable attachment device.

Additionally, one or more channels 210 may be integrated into the panel. These channels may provide an attachment point for an internal frame used to provide rigid support for the panel 202. The internal frame is discussed below in the discussion of FIG. 3. Multiple channels 210 may be included, one on each edge of panel 202 such that individual components of the internal frame may be slid into the channels and provide rigid support for the panel. The corners of channels 210 may be left open to provide access to the internal frame as well as to provide an area where individual components of the internal frame may be attached to one another.

As shown in FIGS. 2A-2C, panel 202 is generally a rectangular shape. It should be noted that this is shown by way of example only. Panel 202 may be any geometric shape, for example a triangle, a square, a pentagon, etc.

Figure 3:
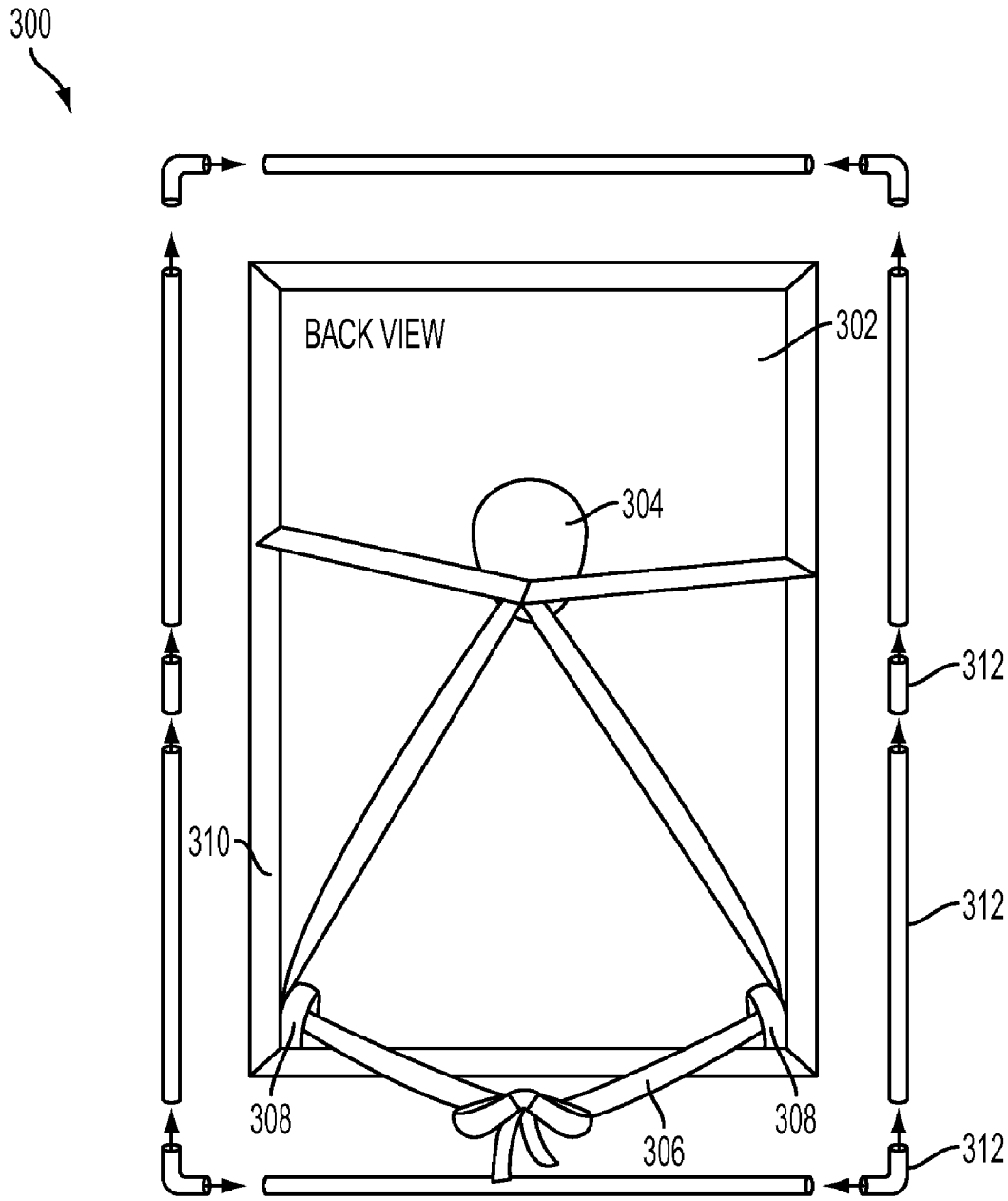
FIG. 3 illustrates a blown-up view of the back of a costume and the associated support structure according to an exemplary embodiment.

FIG. 3 illustrates an exploded view of costume 300, shown without a wearer. Panel 302 is shown from the back, without a design. A single hole 304 is included for a potential wearer's head. Two flexible straps 306 are shown in a similar cross pattern as discussed above in reference to FIG. 2C. Similarly, multiple attachment points 308 are shown for attaching straps 206 to the panel 202. Multiple channels 310 are also shown for accommodating internal frame 312.

In exemplary costume 300, internal frame 312 has been removed from the channels 310 and exploded into its various components. As shown, the long sides of internal frame 312 are constructed from multiple pieces, while the top and bottom of the frame are a single, shorter piece. Ninety degree bends are used to attach the pieces of the internal frame 312 at the corners. By making the internal frame 312 removable from panel 302, costume 300 quickly collapses for easy transport and/or storage. Panel 302 may further include a pocket or pouch for storing the individual components of internal frame 312 such that the entire costume 300 can be stored as a single unit, thereby eliminating or greatly reducing the chances of losing any individual components of the frame.

Internal frame 312 may be constructed from a lightweight but sturdy material such as small diameter plastic tubing or pipe (e.g., ¼ or ½ inch poly(vinyl chloride) (PVC) pipe). It should be noted that while only four sides of internal frame 312 are shown in FIG. 3, if the shape of panel 302 is altered, the internal frame may be adjusted to accommodated any changes. For example, if panel 302 is designed as a triangle, three sides of internal frame 312 may be used along with different corner pieces corresponding to the angles used for the triangle. If panel 302 is shaped such that it is an equilateral triangle, three equal length sides may be used for internal frame 312, along with sixty degree corner pieces.

It will be appreciated that various of the above-disclosed and other features and functions, or alternatives thereof, may be desirably combined into many other different systems or applications. Also that various presently unforeseen or unanticipated alternatives, modifications, variations or improvements therein may be subsequently made by those skilled in the art which are also intended to be encompassed by the following claims.

What is claimed is:

1. A customizable costume to be worn by a wearer comprising:

a panel having a first shape, at least one edge, a hole formed therethrough, a plurality of attachment points, and at least one channel disposed on the at least one edge of the panel;

at least one flexible strap passing through at least one of the plurality of attachment points and configured to affix the costume to the wearer; and an internal frame affixed to the panel in the at least one channel, the internal frame configured to provide rigid support for the panel, wherein the internal frame comprises a plurality of detachably connected frame members configured to fit together to form the internal frame, and wherein the internal frame forms the first shape of the panel when fitted together.

2. The costume of claim 1, wherein the panel is made from a lightweight material.

3. The costume of claim 2, wherein the lightweight material is at least one of cloth, paper, cardboard, and foam.

4. The costume of claim 2, wherein the at least one flexible strap is made from a similar material as that of the panel.

5. The costume of claim 1, wherein the panel comprises a design positioned on the panel such that, when the wearer puts their head through the hole, the wearer's head is positioned relative to the design so as to be integrated with the design.

6. The costume of claim 5, wherein the design is a magazine cover.

7. A customizable costume to be worn by a wearer comprising:

a panel having a first shape, at least one edge, a hole formed therethrough and positioned to accommodate the wearer's head, a plurality of attachment points, and at least one channel disposed on the at least one edge of the panel;

at least one flexible strap passing through at least one of the plurality of attachment points and configured to adjustably affix the costume to the wearer; and an internal frame affixed to the panel in the at least one channel, the internal frame configured to provide rigid support for the panel such that the panel is held tightly while the wearer is wearing the costume, wherein the internal frame comprises a plurality of detachably connected frame members configured to fit together to form the internal frame, and wherein the internal frame forms the first shape of the panel when fitted together.

8. The costume of claim 7, wherein the panel is made from a lightweight material.

9. The costume of claim 8, wherein the lightweight material is at least one of cloth, paper, cardboard, and foam.

10. The costume of claim 8, wherein the at least one flexible strap is made from a similar material as that of the panel.

11. The costume of claim 7, wherein the panel comprises a design positioned on the panel such that, when the wearer puts their head through the hole, the wearer's head is positioned relative to the design so as to be integrated with the design.

12. The costume of claim 11, wherein the design is a magazine cover.

* * * * *